US007794216B2

(12) United States Patent
Kitamura

(10) Patent No.: US 7,794,216 B2
(45) Date of Patent: Sep. 14, 2010

(54) HIGH-PRESSURE PUMP

(75) Inventor: Takeshi Kitamura, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 129 days.

(21) Appl. No.: 11/598,005

(22) Filed: Nov. 13, 2006

(65) Prior Publication Data

US 2007/0128058 A1 Jun. 7, 2007

(30) Foreign Application Priority Data

Dec. 2, 2005 (JP) ..... 2005-349731

(51) Int. Cl.
*F04B 9/04* (2006.01)

(52) U.S. Cl. ..... 417/470; 92/159

(58) Field of Classification Search ..... 417/470; 92/81, 159, 162 R; 184/6.5–6.7
See application file for complete search history.

(56) References Cited

U.S. PATENT DOCUMENTS

| | | | | |
|---|---|---|---|---|
| 2,007,197 | A * | 7/1935 | Hedblom | 417/203 |
| 4,776,260 | A * | 10/1988 | Vincze | 92/86 |
| 5,984,650 | A * | 11/1999 | Okubo et al. | 417/470 |
| 6,394,770 | B1 * | 5/2002 | Siegel et al. | 417/470 |
| 6,530,759 | B2 * | 3/2003 | Sano et al. | 417/470 |

FOREIGN PATENT DOCUMENTS

| | | | |
|---|---|---|---|
| DE | 40 26 689 | A1 | 3/1991 |
| DE | 692 20 314 | T2 | 1/1998 |
| DE | 60 2004 001 409 | T2 | 2/2007 |
| EP | 1 130 250 | A1 | 9/2001 |
| JP | 59-194570 | U | 12/1984 |
| JP | 2000-045907 | A | 2/2000 |
| JP | 2001-41129 | | 2/2001 |
| JP | 2003-049745 | A | 2/2003 |

* cited by examiner

*Primary Examiner*—Devon C Kramer
*Assistant Examiner*—Philip Stimpert
(74) *Attorney, Agent, or Firm*—Kenyon & Kenyon LLP

(57) ABSTRACT

A plunger is inserted into a slide hole of a cylinder body provided between a pressurizing chamber and a drive cam, so as to reciprocate within the slide hole. The drive cam and a coil spring move the plunger toward the drive cam so that fuel is sucked into the pressurizing chamber, and also move the plunger toward the pressurizing chamber so that the fuel in the pressurizing chamber is pressurized. A clearance between the plunger and a wall of the slide hole forms a flow passage of the fuel discharged from the pressurizing chamber. In the high-pressure fuel pump constructed as above, a fluid reservoir is provided in the flow passage. The capacity of the fluid reservoir increases as the plunger moves toward the drive cam, and decreases as the plunger moves toward the pressurizing chamber.

9 Claims, 13 Drawing Sheets

HIGH-PRESSURE PUMP

INCORPORATION BY REFERENCE

The disclosure of Japanese Patent Application No. 2005-349731 filed on Dec. 2, 2005 including the specification, drawings and abstract is incorporated herein by reference in its entirety.

BACKGROUND OF THE INVENTION

1. Field of the Invention

The invention relates to a high-pressure pump that performs an intake stroke during which fluid is sucked into a pressurizing chamber and a pressurizing stroke during which the fluid in the pressurizing chamber is pressurized by reciprocating a plunger in a slide hole of a cylinder body and thus changing the capacity of the pressurizing chamber.

2. Description of the Related Art

For example, a high-pressure pump including a plunger is incorporated in a vehicle engine, which, for example, supplies fuel to fuel injection valves (refer to Japanese Patent Application Publication No. JP-A-2001-41129).

As shown in FIG. 15, the high-pressure pump includes a cylinder body 71, a plunger 73, a pressurizing chamber 74, a lifter 75, and a drive cam 76. The plunger 73 is inserted into a slide hole 72 of the cylinder body 71 such that it can reciprocate therein, and the pressurizing chamber 74 is provided at one end of the slide hole 72 (the upper end as viewed in FIG. 15). The lifter 75 and the drive cam 76 are provided at the other end of the slide hole 72 (the lower end as viewed in FIG. 15). The lifter 75 abuts on the plunger 73 at the inner bottom surface of the lifter 75 and reciprocates as guided by a lifter guide 77. The lifter 75 is urged by a spring 78 toward the drive cam 76. As the drive cam 76 rotates and the plunger 73 thus reciprocates in the slide hole 72, the capacity of the pressurizing chamber 74 changes, whereby fuel 79 is sucked into and pressurized in the pressurizing chamber 74.

Specifically, as the drive cam 76 rotates past a point where the plunger 73 is at the top dead center, the pushing force exerted by the drive cam 76 decreases, and the lifter 76 urged by the spring 78 moves down to the drive cam 76 side. During this, the capacity of the pressurizing chamber 74 gradually increases, and the fuel 79 is sucked into the pressurizing chamber 74 (intake stroke). On the other hand, as the plunger 73 rotates past a point where the plunger 73 is at the bottom dead center, the pushing force of the drive cam 76 increases, and the lifter 75 moves up to the pressurizing chamber 74 side against the urging force of the spring 78. During this, the capacity of the pressurizing chamber 74 gradually decreases, and the fuel 79 in the pressurizing chamber 74 is pressurized (pressurizing stroke). Then, the outflow of the fuel 79 from the pressurizing chamber 74 is interrupted by an electromagnetic spill valve 81 being closed in a pressurizing stroke, so that the fuel 79 is pressurized to a high pressure. When the pressure of the fuel 79 exceeds a specified value, a check valve 82 opens and the fuel 79 is discharged to the fuel injection valve side.

As shown in FIG. 16, a small space between the plunger 73 and a wall 83 forms a flow passage 84 of the fuel 79 discharged from the pressurizing chamber 74. The fuel 79 distributed via the flow passage 84 serves as lubricant and coolant and suppresses seizure due to heat generated by the reciprocation of the plunger 73.

In the high-pressure pump 85, when the pressure of the fuel 79 increases as the plunger moves toward the pressurizing chamber 74, a reaction force Fr caused by the pressure increase acts toward the drive cam 76. On the other hand, when the drive cam 76 pushes the lifter 75 upward and the plunger 73 moves toward the pressurizing chamber 74, a pushing force Fu acts from the drive cam 76 toward the pressurizing chamber 74.

The drive cam 76 contacts a center C of the lifter 75 at a base circle portion 76A. A contact portion Pa of the drive cam 76 at which it contacts the lifter 75 shifts and deviates from the center C of the lifter 75 as the drive cam 76 rotates. This causes the lifter 75 to incline within an allowable range corresponding to the clearance between the lifter 75 and the lifter guide 77, as shown in FIG. 16. When this occurs, the plunger 73, due to its moment, also inclines in a certain direction in the slide hole 72. When the plunger 73 thus inclines, pressing force (side force Fs) is exerted from the plunger 73 to an end portion Ep of the slide hole 72 in the pressurizing chamber side and to an end portion Ed of the slide hole 72 in the drive cam side.

According to the trend in recent years, the fuel discharge amount or the fuel discharge pressure of a high-pressure fuel pump like the fuel pump 85 described herein is often increased to improve the engine performance. However, in this case, there is a possibility that the side force Fs may increase. That is, to increase the fuel discharge amount of the fuel pump 85, it is effective to advance the close timing of the electromagnetic spill valve 81 to a point close to the bottom dead center. However, this increases the reaction force Fr caused by an increase in the pressure of fuel 79, and therefore increases the side force Fs. As a result, more heat is generated at the drive cam side end portion Ed and the pressurizing chamber side end portion Ep of the slide hole 72 as the plunger 73 slides in the slide hole 72. In this case, therefore, a large amount of fuel 79 is needed to prevent seizure. In the conventional high-pressure pump 85, however, since the volume of fuel 79 in the pressurizing chamber 74 is large, heat can be sufficiently released from the pressurizing chamber side end portion Ep that is close to the pressurizing chamber 74. However, there is a possibility that a sufficient amount of fuel 79 may not be supplied to the drive cam side end portion Ed that is far from the pressurizing chamber 74.

In the Japanese Patent Application Publication No. JP-A-2001-41129, the clearance between the plunger 73 and the wall 83 of the slide hole 72 is made larger in the pressurizing chamber 74 side than in the drive cam 76 side, so that the plunger 73 contacts the drive cam side end portion Ed prior to the pressurizing chamber side end portion Ep. However, no measures have been taken for the drive cam side end portion Ed. Therefore, there is still a possibility that the aforementioned problem may occur.

SUMMARY OF THE INVENTION

It is an object of the invention to provide a high-pressure pump which enables a large amount of fluid, among that sent from the pressurizing chamber into the flow passage, to be distributed to the drive cam side end portion.

Hereinafter, structures for achieving the aforementioned object and their effects and advantages will be described. A first aspect of the invention relates to a high-pressure pump in which: a plunger is inserted into a slide hole of a cylinder body provided between a pressurizing chamber and a drive cam, so as to reciprocate within the slide hole; the drive cam moves the plunger toward the drive cam so as to cause fluid to be sucked into the pressurizing chamber; the drive cam moves the plunger toward the pressurizing chamber so as to cause the fluid to be pressurized in the pressurizing chamber; and a space between the plunger and a wall of the slide hole forms a flow passage of the fluid discharged from the pressurizing chamber. In this high-pressure pump, a fluid reservoir whose capacity increases as the plunger moves toward the drive cam and decreases as the plunger moves toward the pressurizing chamber is provided in the flow passage.

According to this structure, the drive cam drives the plunger to reciprocate in the slide hole of the cylinder body. When the plunger moves toward the drive cam, the capacity of the pressurizing chamber increases, whereby the fluid is sucked into the pressurizing chamber. At this time, the capacity of the fluid reservoir provided in the flow passage also increases, so that a part of the fluid in the pressurizing chamber is sucked into the fluid reservoir.

When the plunger moves toward the pressurizing chamber, the capacity of the pressurizing chamber decreases, whereby the fluid in the pressurizing chamber is pressurized. At this time, the capacity of the fluid reservoir also decreases, so that the fluid therein is pressurized and discharged into the flow passage. Accordingly, a large amount of fluid is supplied to a portion in the drive cam side of the fluid reservoir, as compared to when the fluid reservoir is not provided.

Accordingly, even when the plunger inclines and slides in the slide hole 31 while being pressed against the drive cam side end portion of the wall of the slide hole, the drive cam side end portion can be sufficiently lubricated and cooled by the large amount of fuel supplied from the fluid reservoir in the aforementioned manner.

The above high-pressure pump may be such that: the slide hole includes a large diameter section provided in the drive cam side and a small diameter section provided in the pressurizing chamber side; and the plunger includes a large diameter portion provided in the drive cam side and a small diameter portion provided in the pressurizing chamber side; the large diameter portion is inserted into the large diameter section; the small diameter portion is inserted into the small diameter section; and the fluid reservoir is formed by a space between a step portion of the slide hole and a step portion of the plunger, the step portion of the slide hole being provided between the large diameter section and the small diameter section, and the step portion of the plunger being provided between the large diameter portion and the small diameter portion.

According to this structure, the small diameter portion of the plunger reciprocates in the small diameter section of the slide hole and the large diameter portion reciprocates in the large diameter section. As the plunger moves toward the drive cam, the step portion of the plunger moves away from the step portion of the slide hole and the capacity of the fluid reservoir therefore increases, whereby the fluid is sucked into the fluid reservoir. In contrast, as the plunger moves toward the pressurizing chamber, the step portion of the plunger approaches the step portion of the slide hole and the capacity of the fluid reservoir therefore decreases, whereby the fluid in the fluid reservoir is pressurized and discharged toward the open end of the large diameter section of the slide hole.

As described above, since the fluid is sucked into and pressurized in the fluid reservoir by the capacity of the fluid reservoir increasing and decreasing as the plunger reciprocates in the slide hole, the effects and advantages obtained with the high-pressure pump according to the first aspect of the invention can be more reliably achieved.

The above high-pressure pump may be such that each of the slide hole and the step portion of the plunger extends along a plane perpendicular to a centerline of the slide hole.

According to this structure, provided that the fluid reservoir is filled with the fluid when the capacity of the fluid reservoir is maximum, the amount of fluid that is equivalent to the amount by which the capacity of the fluid reservoir changes (decreases) as the plunger 32 moves toward the pressurizing chamber 35 is discharged from the fuel reservoir 55.

Further, in the above structure in which each of the step portion of the plunger and the step portion of the slide hole extends on a plane perpendicular to the centerline of the slide hole, the aforementioned change in the capacity of the fluid reservoir can be determined as the product of the area of the step portion of the slide hole (or the area of the step portion of the plunger) and the distance that the plunger moves. In other words, the area of the step portion and the distance that the plunger moves are the elements that determine the amount of fluid to be discharged from the fluid reservoir. By changing these elements in various manners, therefore, the amount of fluid to be discharged from the fluid reservoir can be easily set to a desired amount.

The above high-pressure pump may be such that the step portion of the slide hole is tapered such that the diameter of the step portion of the slide hole increases toward the drive cam.

According to this structure, the inner diameter of the tapered step portion of the slide hole increases toward the drive cam, and therefore the clearance between the step portion and the small diameter portion of the plunger increases toward the drive cam. As such, the resistance against the fluid that flows to the fluid reservoir during an intake stroke in which the plunger 32 moves toward the drive cam 22 is smaller than when the step portion 58 is made perpendicular to the centerline L of the slide hole 31. As a result, the fluid can be efficiently sucked into the fluid reservoir.

The above high-pressure pump may be such that the step portion of the plunger is tapered such that the diameter of the step portion of the plunger increases toward the drive cam.

According to this structure, the outer diameter of the tapered step portion of the plunger increases toward the drive cam, and therefore the clearance between the step portion and the large diameter section of the slide hole decreases toward the drive cam. So, the resistance against the fluid that is discharged from the fluid reservoir as the plunger moves toward the pressurizing chamber is smaller than when the step portion is made perpendicular to the centerline of the sliding portion, whereby the flowability of fluid improves. As a result, the lubrication and cooling performances improve.

The above high-pressure pump may be such that a portion of the flow passage in the drive cam side of the fluid reservoir has a larger cross-sectional area than a portion of the flow passage in the pressurizing chamber side of the fluid reservoir.

According to this structure, as the plunger moves toward the pressurizing chamber and the capacity of the fluid reservoir decreases, the fluid in the fluid reservoir is discharged from the fuel reservoir to either or both of the drive cam side and the pressurizing chamber side. At this time, a larger amount of fluid is discharged from the fluid reservoir 55 to where the flow resistance is smaller, that is, to where the cross-sectional area is larger.

In the above structure in which the portion in the drive cam side of the fluid reservoir has a larger cross-section than the portion in the pressurizing chamber side, a larger amount of fluid is discharged from the fluid reservoir to the drive cam side than to the pressurizing chamber side. That is, the portion in the drive cam side includes a portion where, during a pressurizing stroke, the plunger slides on the wall of the slide hole at a high surface pressure and much heat is therefore generated. To counter this, the above structure enables a large amount of fluid to be supplied to the portion in the drive cam side.

The above high-pressure pump may be such that, at the portion of the flow passage in the drive cam side of the fluid reservoir, the clearance between the plunger and the wall of the slide hole is larger in a side where the plunger contacts a drive cam side end portion of the wall of the slide hole when the plunger moves toward the pressurizing chamber than in a side where the plunger does not contact the drive cam side end portion of the wall of the slide hole when the plunger moves toward the pressurizing chamber.

According to this structure, when the fluid is discharged from the fluid reservoir to the drive cam side, majority of the fluid is discharged to where the clearance between the plunger and the wall of the large diameter section is large and therefore the flow resistance is small. In the above structure, this large clearance between the plunger and the wall of the large diameter section 56 is made in the side where the plunger contacts the drive cam side end portion of the wall of the large diameter section when the plunger moves toward the pressurizing chamber. Therefore, majority of the fluid in the fluid reservoir can be supplied to where lubrication and cooling by the fluid is particularly needed.

The fluid reservoir may be provided close to where the plunger contacts the wall of the slide hole at a highest surface pressure.

The above high-pressure pump may be such that a pressure of the fluid supplied to a proximity of the first portion is larger than a pressure of the fluid supplied to a portion other than the first portion.

When the fluid reservoir is provided at the above-mentioned position,. the sucking-in and pressurizing of the fluid is performed near where the plunger contacts the wall of the slide hole at the highest surface pressure when the plunger slides on the same wall. That is, a large amount of the fluid can be supplied to where much heat is generated due to the plunger sliding on the wall of the slide hole at the highest pressure and thus lubrication and cooling by the fluid is particularly needed.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

A high-pressure pump according to a first embodiment of the invention which is applied to a fuel supply system of an engine will be described with reference to FIGS. 1 to 8.

Figure 1:
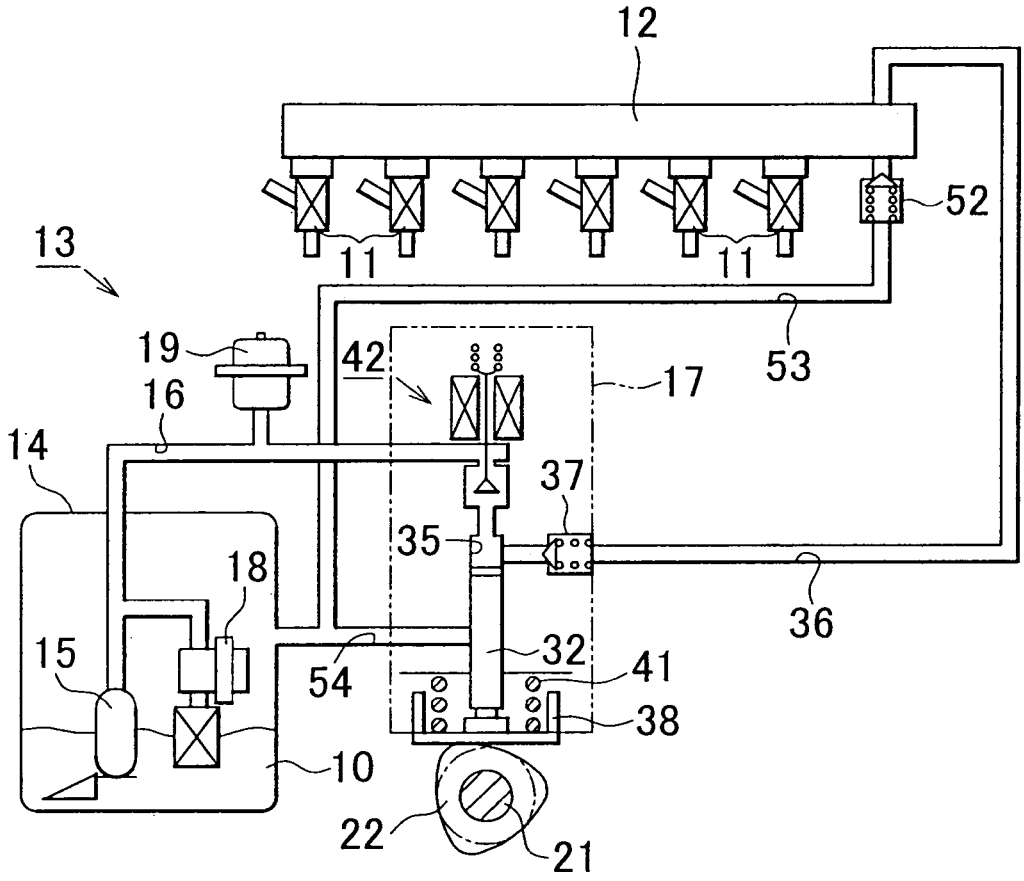
FIG. 1 is a view schematically showing a fuel supply system in which the high-pressure fuel pump according to the first embodiment of the invention is employed.

As shown in FIG. 1, a delivery pipe 12 is connected to each of the fuel injection valves 11 that are provided for the respective cylinders of the engine. The delivery pipe 12 serves as a high-pressure fuel pipe and is shared among fuel injection valves 11, and fuel in the delivery pipe 12 is distributed to each of the fuel injection valves 11. Each of the fuel injection valves 11 is controlled to open and close, whereby high-pressure fuel is directly supplied to the combustion chamber of each cylinder. The fuel injected is then mixed with air in the combustion chamber and air-fuel mixture is thus produced.

A fuel supply apparatus 13 for supplying high-pressure fuel to the delivery pipe 12 includes a low-pressure fuel pump 15 and a high-pressure fuel pump 17. The low-pressure fuel pump 15 is fixed in a fuel tank 14, and the high-pressure fuel pump 17 is fixed to the engine and connected to the low-pressure fuel pump 15 through a low-pressure fuel passage 16.

The low-pressure fuel pump 15 is driven by an electronic motor (not shown) which runs on power supplied from a battery. The low-pressure fuel pump 15 pumps fuel 10 up from the fuel tank 14 and discharges the fuel 10 into the low-pressure fuel passage 16. The reference numeral 18 in FIG. 1 denotes a pressure regulator that keeps the fuel pressure (feed pressure) in the low-pressure fuel passage 16 constant. The reference numeral 19 denotes a pulsation damper that reduces pulsation of the fuel 10 in the low-pressure fuel passage 19.

Figure 2:
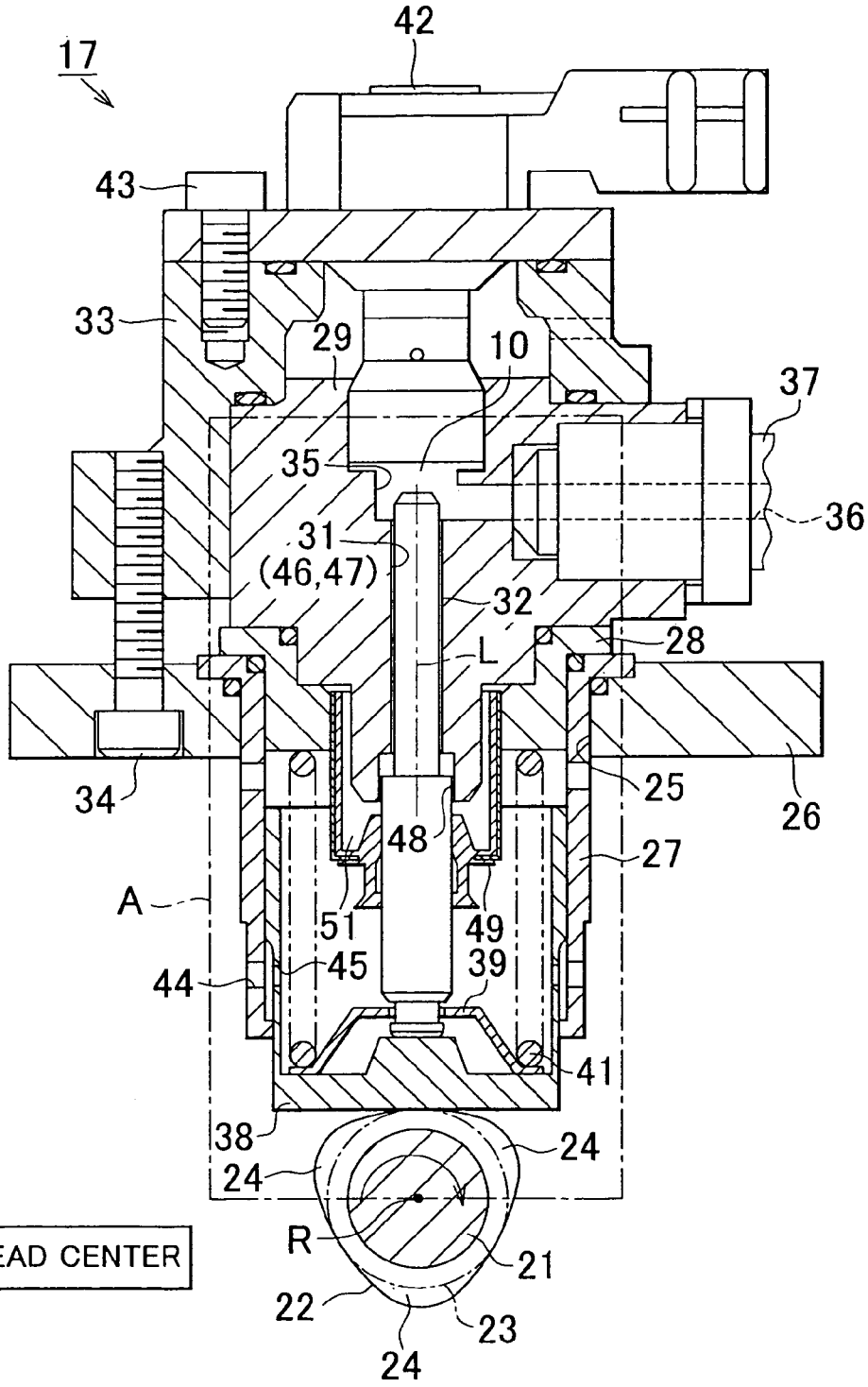
FIG. 2 is a cross-sectional view of the high-pressure fuel pump shown in FIG. 1.
Figure 3:
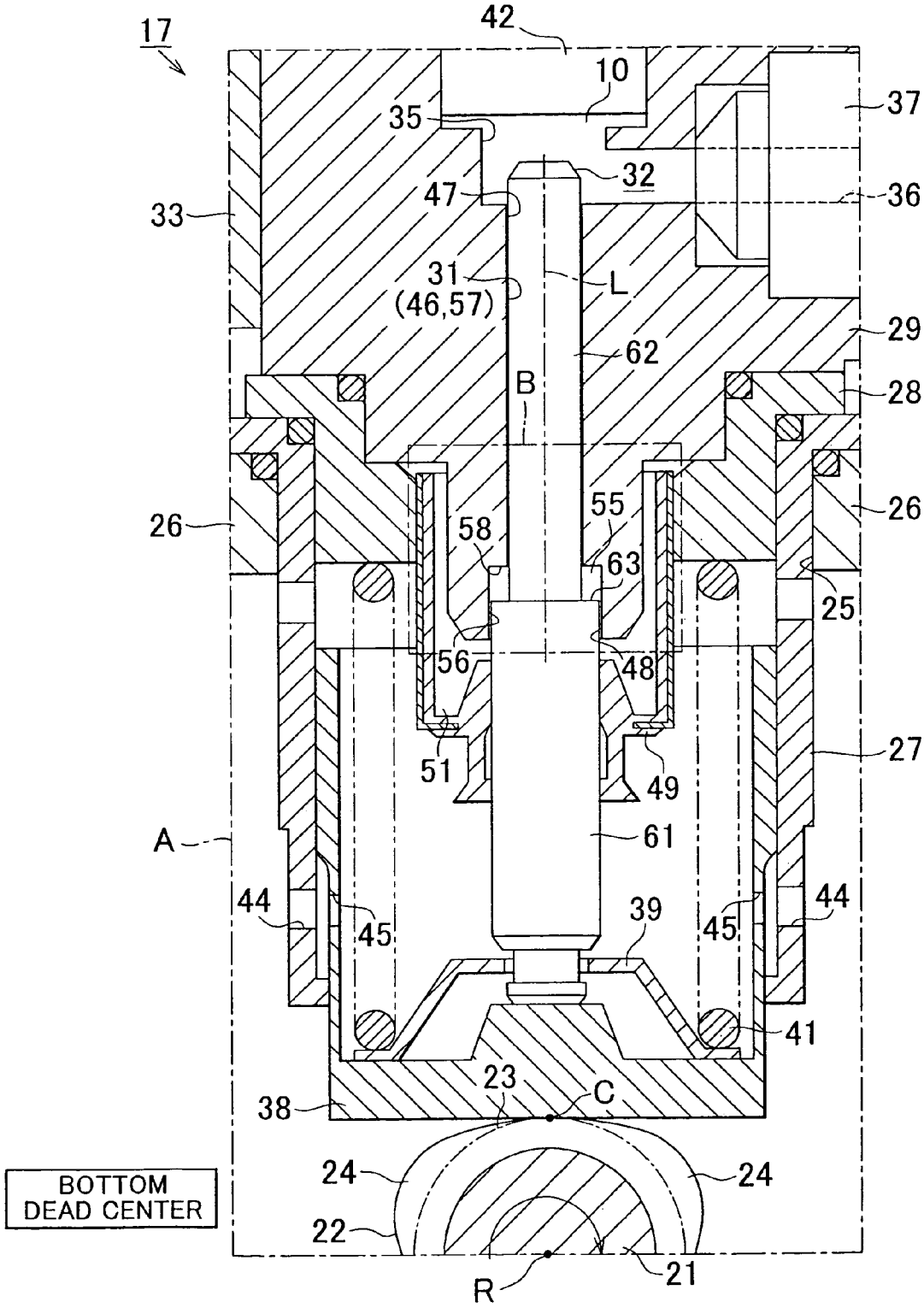
FIG. 3 is an enlarged cross-sectional view of the portion A in FIG. 2.

As shown in FIGS. 2 and 3, the high-pressure fuel pump 17 is driven by a camshaft 21 of the engine, and through reciprocation of a plunger 32, sucks in and pressurizes the fuel 10 distributed from the low-pressure pump 15 through the low-pressure fuel passage 16.

More specifically, as shown by the arrows in the figures, a drive cam 22 that drives the high-pressure fuel pump 17 is provided on the camshaft 21 that rotates clockwise. The drive cam 22 includes a base circle portion 23 that is shaped like a disc, and a plurality of cam noses 24 that protrude from the base circle portion 23.

The high-pressure fuel pump 17 is provided with a bracket 26 having a hole 25, and is fixed to the cylinder head of the engine by the bracket 26. The hole 25 is located in the proximity of the drive cam 22, and a lifter guide 27 which has a generally cylindrical shape and has an opening at each end is inserted into the hole 25. One end (the lower end as viewed in FIGS. 2 and 3) of a cylinder body 29 is attached to one open end of the lifter guide 27 (the upper open end as viewed in FIGS. 2 and 3) through a seat 28 that has a generally cylindrical shape. A slide hole 31 having an opening at each end is formed in the cylinder body 29. A centerline L of the slide hole 31 and a rotation center R of the camshaft 21 are on a common plane. The plunger 32 is inserted into the slide hole 31 such that it can reciprocate therein.

A cover 33 covers one end (the upper end as viewed in FIG. 2) of the cylinder body 29. The cover 33 is fixed to the bracket 26 by a bolt 34 so that the cylinder body 29 is supported between the cover 33 and the bracket 26.

A pressurizing chamber 35 is formed in the cylinder body 29 and is connected to the slide hole 31. The pressuring chamber 35 is also connected to the low-pressure fuel passage 16 so as to allow the fuel 10 discharged from the low-pressure fuel pump 15 to flow into the pressurizing chamber 35 via the low-pressure fuel passage 16. The pressuring chamber 35 is further connected to the delivery pipe 12 through the high-pressure fuel passage 36 (as shown in FIG. 1). In the cylinder body 29, a check valve 37 is provided at a joint portion between the pressuring chamber 35 and the high-pressure fuel passage 36. The check valve 37 opens only when the pressure of the fuel 10 in the pressurizing chamber 35 exceeds a specified value.

The following construction is employed in order to enable the capacity of the pressurizing chamber 35 to change as the rotation of the drive cam 22 transmits to and thus drives the plunger to reciprocate in the slide hole 31. A lifter 38 which is a cylindrical member closed at the bottom is fit in the lifter guide 27 such that the lifter 38 can reciprocate along the centerline L. A portion of the plunger 32 (the lower portion of the plunger 32 as viewed in FIGS. 2 and 3) is located in the lifter guide 27 outside the cylinder body 29. A retainer 39 is attached to the outer periphery of the drive cam 22 side end portion of the plunger 32, and a coil spring 41 is arranged, in a contracted state, between the retainer 39 and the seat 28. The coil spring 41 presses the plunger 32 against the inner bottom surface of the lifter 38 through the retailer 39, and thus presses the lifter 38 against the drive cam 22.

The position of the plunger 32 in the direction along the centerline L changes as the position of contact between the drive cam 22 and the lifter 38 changes. For example, when the base circle portion 23 of the drive cam 22 contacts the center C of the lifter 38, the plunger 32 is located closest to the rotation center R of the camshaft 21 within the movable range of the plunger 32, i.e., at the bottom dead center. At this time, the plunger 32 is located at the farthest position from the pressurizing chamber 35, and therefore, the capacity of the pressurizing chamber 35 is maximum.

On the other hand, when one of the cam noses 24 of the drive cam 22 contacts the lifter 38, the plunger 32 is located in the pressurizing chamber 35 side of the bottom dead center within the movable range of the plunger 32.

Figure 7:
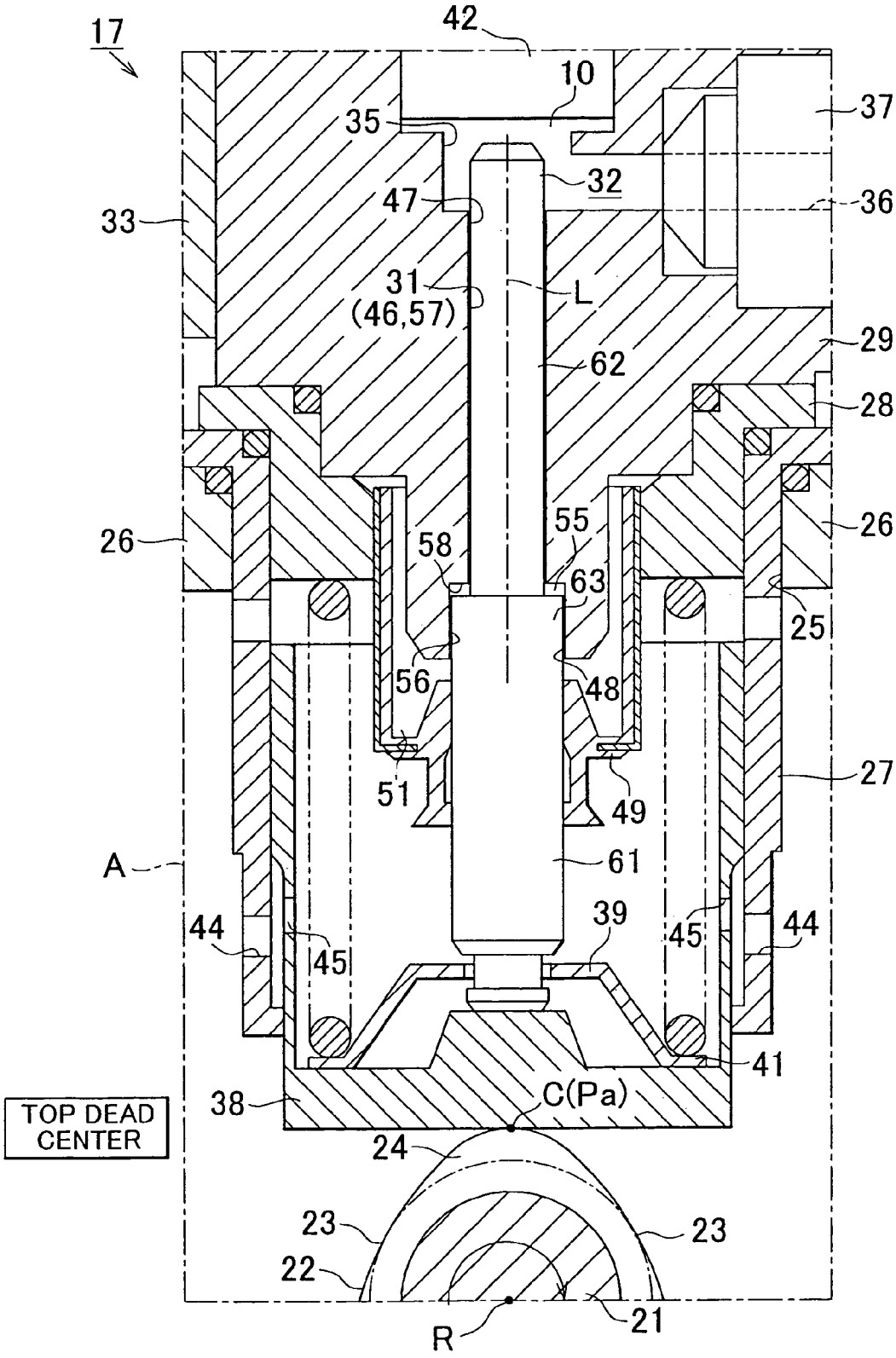
FIG. 7 is a cross-sectional view showing the state of the portion A of the high-pressure fuel pump when the drive cam further rotates from the state shown in FIG. 6 and the plunger reaches the top dead center.

As shown in FIG. 7, when a portion of the cam nose 24 of the drive cam 22 which is distal from the base circle portion 23, i.e., the tip of the same nose 24, contacts the center C of the lifter 38, the plunger 32 is farthest from the rotation center R of the camshaft 21, i.e., at the top dead center. At this time, one end of the plunger 32 (the upper end of the plunger 32 as viewed in FIG. 7) is located at the innermost position within the pressurizing chamber 35, and therefore, the capacity of the pressurizing chamber 35 is minimum.

Figure 6:
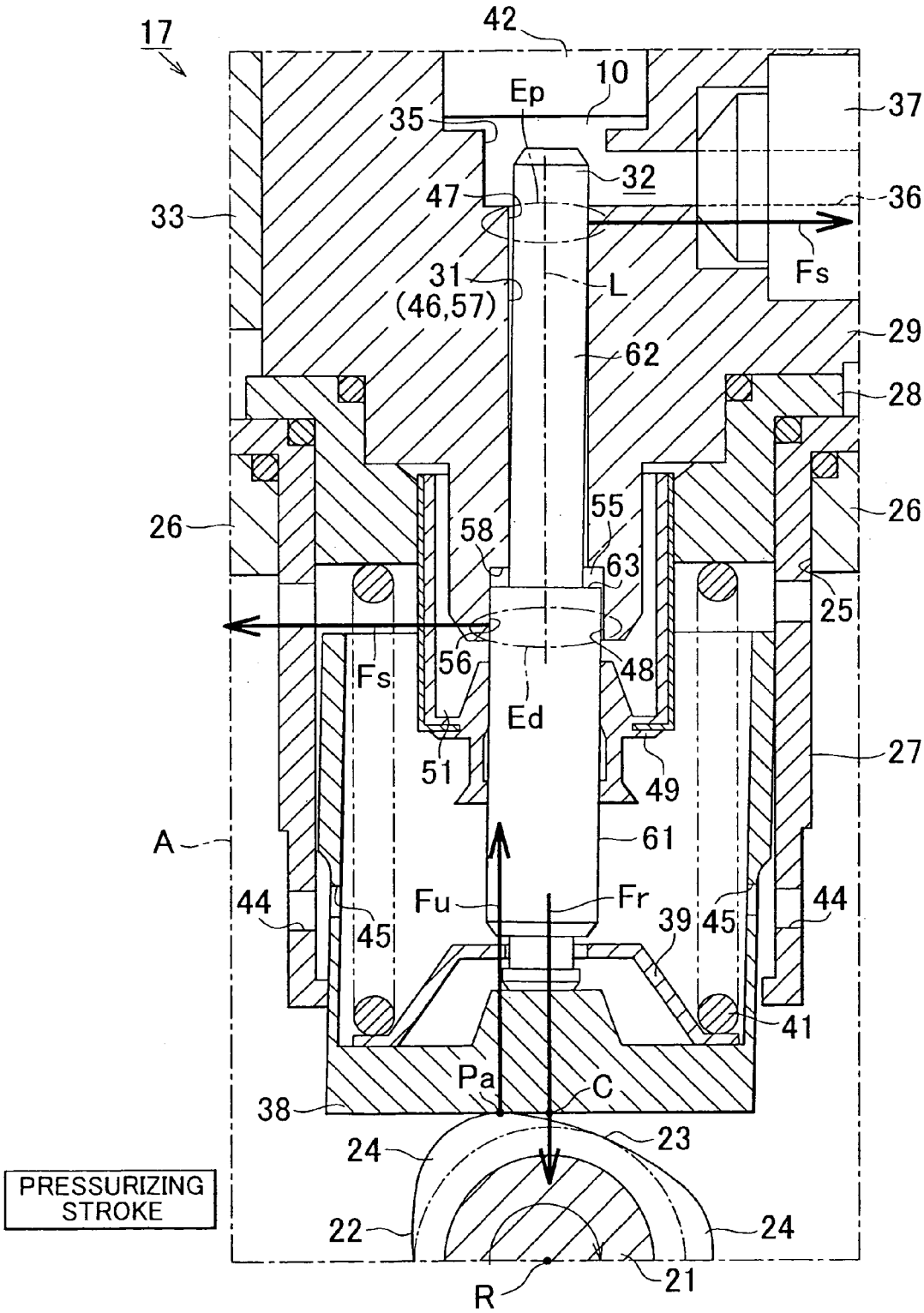
FIG. 6 is a cross-sectional view showing the state of the portion A of the high-pressure fuel pump when the drive cam further rotates from the state shown in FIG. 3 and the plunger moves upward.
Figure 8:
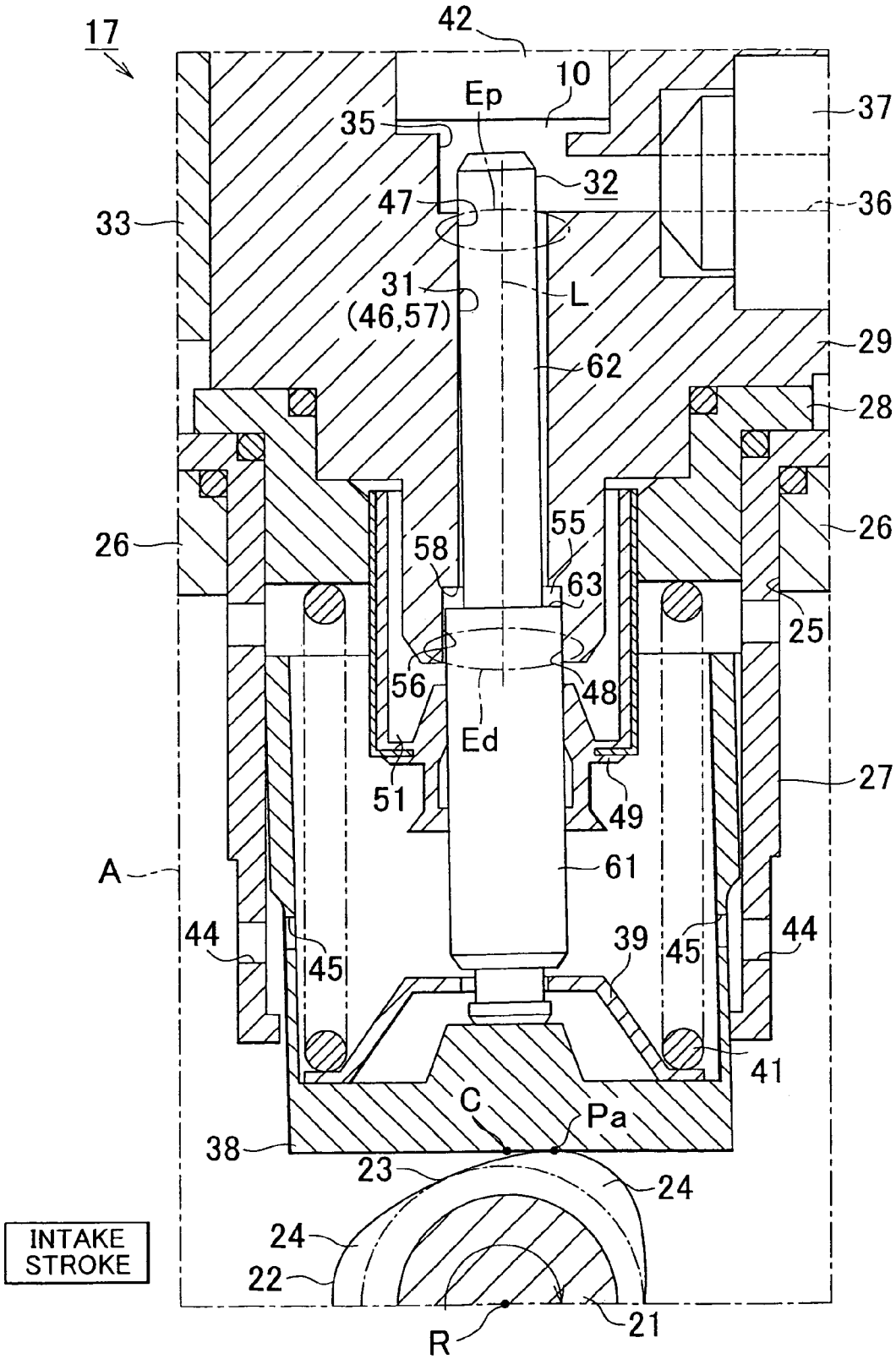
FIG. 8 is a cross-sectional view showing the state of the portion A of the high-pressure fuel pump when the drive cam further rotates from the state shown in FIG. 7 and the plunger moves downward.

Then, the capacity of the pressurizing chamber, as shown in FIG. 8, gradually increases during the stroke in which the plunger 32 moves from the top dead center to the bottom dead center (intake stroke). Further, the capacity of the pressurizing chamber 35, as shown in FIG. 6, gradually decreases during the stroke in which the plunger 32 moves from the bottom dead center to the top dead center (pressurizing stroke).

As shown in FIGS. 1 and 2, the high-pressure fuel pump includes an electromagnetic spill valve 42 that allows and interrupts the communication between the low-pressure fuel passage 16 and the pressurizing chamber 35. The electromagnetic spill valve 42 is fixed to the cover 33 by a bolt 43. The electromagnetic spill valve 42 includes an electromagnetic solenoid. When power is not supplied to the electromagnetic solenoid, the electromagnetic spill valve 42 is open, so the low-pressure fuel passage is connected to the pressurizing chamber 35. When power is supplied to the electromagnetic solenoid, the electromagnetic spill valve 42 is closed, so the low-pressure fuel passage 16 is shut off from the pressurizing chamber 35.

The electromagnetic spill valve 42 is kept opened for the entire intake stroke in which the capacity of the pressurizing chamber 35 increases. Therefore, during an intake stroke, the fuel 10 is introduced from the low-pressure fuel passage 16 to the pressurizing chamber 35. The electromagnetic spill valve 42 is closed at a given timing during a pressurizing stroke in which the capacity of the pressurizing chamber 35 generally decreases. On a pressurizing stroke, during an open-valve period from when the electromagnetic spill valve 42 is opened to when the valve is closed, the fuel 10 in the pressurizing chamber 35 flows back to the low-pressure fuel passage 16. During a close-valve period from when the electromagnetic spill valve 42 is closed to when the pressurizing stroke ends, the fuel 10 is pressurized in the pressurizing chamber 35. Then, when the pressure of fuel 10 exceeds the specified value, the check valve 37 opens, discharging the fuel 10 in the pressurizing chamber 35 into the high-pressure fuel passage 36.

At this point, if the timing of closing the electromagnetic spill valve 42 is changed to other within a pressurizing stroke, the amount of fuel 10 that flows back from the pressurizing chamber 35 to the low-pressure fuel passage 16 changes accordingly. Thus, the amount of fuel 10 discharged from the high-pressure fuel pump 17 can be adjusted by adjusting the close timing of the electromagnetic spill valve 42.

For example, when the close timing of the electromagnetic spill valve 42 is advanced through the power supply control of the electromagnetic spill valve 42, the amount of fuel 10 that flows back from the pressurizing chamber 35 to the low-pressure fuel passage 16 during a pressurizing stroke decreases, so that the amount of fuel 10 discharged from the pressurizing chamber 35 to the high-pressure fuel passage 36 during the open-valve period of the electromagnetic spill valve 42 in a pressurizing stroke increases. If the electromagnetic spill valve 42 is opened when the plunger 32 reaches the bottom dead center, that is, when the plunger stroke switches from an intake stroke to a pressurizing stroke, the overflow amount of fuel 10 becomes minimum, and therefore the amount of fuel 10 discharged from the pressurizing chamber 35 to the high-pressure fuel passage 36 becomes maximum.

Meanwhile, when the close timing of the electromagnetic spill valve 42 is delayed through the power supply control of the electromagnetic spill valve 42, the amount of fuel 10 that flows back from the pressurizing chamber 35 to the low-pressure fuel passage 16 during a pressurizing stroke increases, so that the amount of fuel 10 discharged from the pressurizing chamber 35 to the high-pressure fuel pump 17 during the open-valve period of the electromagnetic spill valve 42 in a pressurizing stroke decreases.

In the high-pressure fuel pump 17 of the embodiment, the close timing of the electromagnetic spill valve 42 is set to or near the bottom dead center of the plunger 32 in order to improve the engine performance. That is, the electromagnetic spill valve 42 is closed when the capacity of the pressurizing chamber 35 becomes maximum or substantially maximum, so that the amount of fuel 10 to be discharged from the high-pressure fuel pump 17 becomes maximum or substantially maximum.

As shown in FIGS. 1 or 3, at least a part of the high-pressure fuel pump 17 is located in the cylinder head, and the oil for lubricating the valve train etc., arranged in the cylinder head is present around the part of the high-pressure fuel pump 17. The contact portion between the drive cam 22 and the lifter 38 is lubricated and cooled by the oil. Further, through holes 44, 45 are formed through the outer peripheral walls of the lifter guide 27 and the lifter 38, and others, and the oil introduced into the interior of the lifter 38 via the through holes 44, 45 lubricates and cools the contact portion between the plunger 32 and the inner bottom surface of the lifter 38.

The annular space between the plunger 32 and a wall 46 of the slide hole 31 forms a flow passage 47 of the fuel 10 that is discharged from the pressurizing chamber 35 especially when the capacity of the pressurizing chamber 35 is decreasing, i.e., during a pressurizing stroke. When flowing in the flow passage 47, the fuel 10 lubricates and cools between the plunger 32 and the wall 46 of the slide hole 31. The fuel 10 then flows out from the flow passage 47 at an open end 48 of the slide hole 31 in the drive cam 22 side. Since the oil is present in the lifter 38 as described above, a seal member 49 is attached to the inner peripheral surface of the seat 28 in order to prevent the fuel 10 from being mixed up with the oil. The seal member 49 is generally cylindrical, and the end portion of the seal member 49 in the drive cam 22 side (the lower end portion as viewed in FIG. 3) closely contacts the outer peripheral surface of the plunger 32 such that the plunger 32 can slide on the seal member 49. The space in the seal member 49 is a reservoir chamber 51 that temporarily stores the fuel 10 that flows through the open end 48. The reservoir chamber 51 is connected to the fuel tank 14 via a return passage 54 (See FIG. 1). The fuel 10 in the reservoir chamber 51 flows through the return passage 54 and returns to the fuel tank 14.

As shown in FIG. 1, a relief valve 52 is provided for the delivery pipe 12, and the relief valve 52 is connected to the fuel tank 14 through a relief passage 53. The relief valve 52 is opened when the fuel pressure in the delivery pipe 12 becomes excessively high and exceeds a predetermined level. When the relief valve 52 is opened, the fuel 10 at high pressure returns to the fuel tank 14 through the relief passage 53.

In the high-pressure fuel pump 17 constructed as above, when the plunger 32 is moving toward the pressurizing chamber 35 and the pressure of fuel 10 is increasing during a pressurizing stroke, reaction force Fr, due to the increase in the pressure of fuel 10, acts toward the drive cam 22 side, as shown in FIG. 6. In addition, when the drive cam 22 is pushing the lifter 38 upward and the plunger 32 is moving toward the drive cam 22 side, pushing force Fu acts from the drive cam 22 toward the pressurizing chamber 35 side. A contact point Pa of the drive cam 22 at which it contacts the lifter 38 shifts and deviates from the center C of the lifter 38 as the drive cam 22 rotates. This causes the lifter 38 to incline within an allowable range corresponding to the clearance between the lifter 38 and the lifter guide 27. When this occurs, the plunger 32, due to its moment, also inclines in a certain direction in the slide hole 31. When the plunger 32 thus inclines, pressing force (side force Fs) is exerted from the plunger 32 to an end portion Ep of the slide hole 31 in the pressurizing chamber side (hereinafter, "pressurizing chamber side end portion Ep") and to an end portion Ed of the slide hole 31 in the drive cam side (hereinafter, "drive cam side end portion Ed").

In particular, in the high-pressure fuel pump 17 of the embodiment, the close timing of the electromagnetic spill valve 42 is set to the bottom dead center of the plunger 32 in order to increase the discharge amount or pressure of fuel 10 so that the engine performance is improved. In this case, however, the reaction force Fr caused by the increase in the pressure of fuel 10 increases during the initial period of a pressurizing stroke, and the side force Fs accordingly increases. As a result, the amount of heat generated by sliding motion of the plunger 32 increases at the pressurizing chamber side end portion Ep and the drive cam side end portion Ed of the slide hole 31. Therefore, a larger amount of fuel 10 is required to prevent a seizure.

Since the volume of fuel 10 in the pressurizing chamber 35 is large, the pressurizing chamber side end portion Ep is lubricated and heat release is promoted. However, the amount of fuel 10 that is supplied to the drive cam side end portion Ed, which is far from the pressurizing chamber side end portion Ep, through the flow passage 47 may not be sufficient, failing to lubricate and cool the drive cam side end portion Ed sufficiently.

To prevent this, in the embodiment, a structure is employed in which a sufficient amount of fuel 10 is supplied to the drive cam side end portion Ed during a pressurizing stroke. Specifically, a fluid reservoir 55 is provided in the flow passage 47 of the fuel 10 at a position that is closer to the pressurizing chamber 35 than the drive cam side end portion Ed of the slide hole 31 is and is near the drive cam side end portion Ed. The capacity of the fluid reservoir 55 increases as the plunger 32 moves toward the drive cam 22, and decreases as the plunger 32 moves toward the pressurizing chamber 35.

Figure 4:
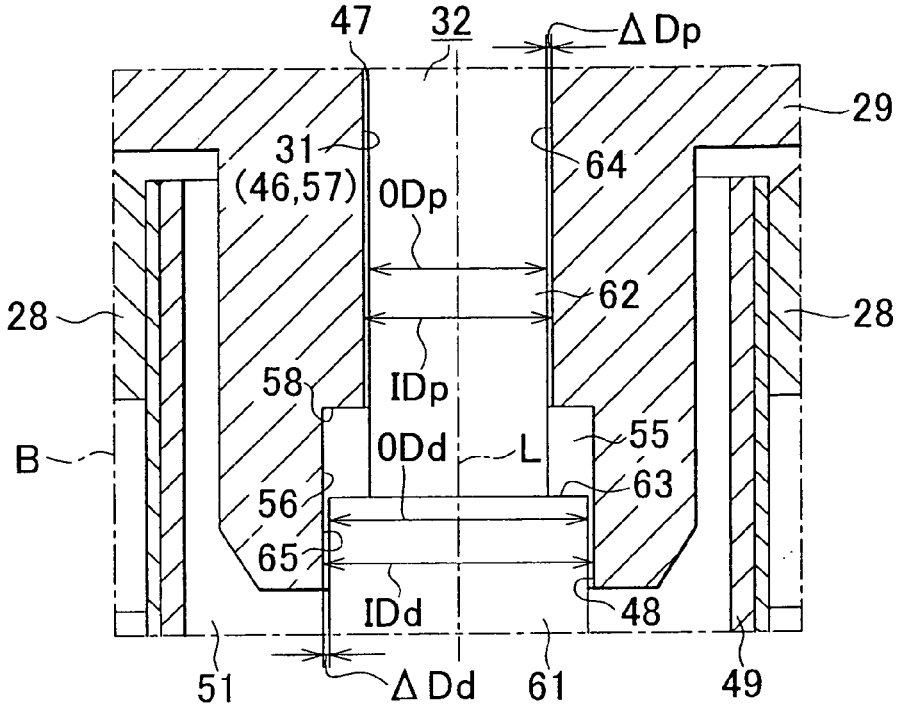
FIG. 4 is an enlarged cross-sectional view of the portion B in FIG. 3.
Figure 5:
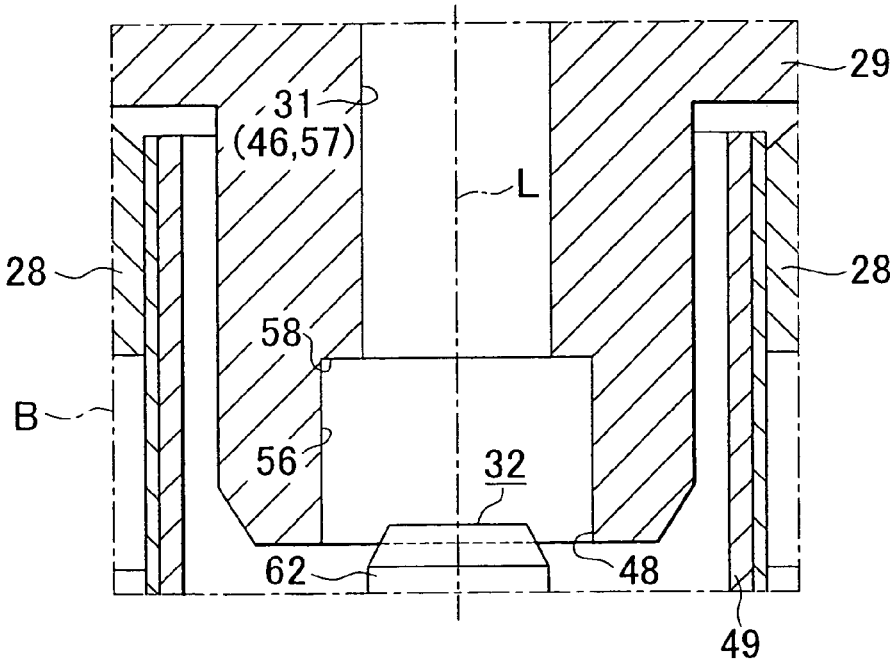
FIG. 5 is a cross-sectional view showing the state before the plunger is inserted into the slide hole in FIG. 4.

More specifically, as shown in FIGS. 4 and 5, the slide hole 31 formed in the cylinder body 29 includes a large diameter section 56 in the drive cam 22 side (the lower portion as viewed in the figure) and a small diameter section 57 in the pressurizing chamber 35 side (the upper portion as viewed in the figure). The large diameter section 56 and the small diameter section 57 both have circular cross-sections. The inner diameter IDd of the large diameter section 56 is set larger than the inner diameter IDp of the small diameter section 57. In the slide hole 31, the boundary between the large diameter section 56 and the small diameter section 57 is a step portion 58 which is annular and perpendicular to the centerline L of the slide hole 31. The step portion 58 is located close to the open end 48 of the slide hole 31 in the drive cam 22 side.

The plunger 32 includes a large diameter portion 61 and a small diameter portion 62. The large diameter portion 61 is located in the drive cam 22 side, and the small diameter portion 62 is located in pressurizing chamber 35 side. The large diameter portion 61 and the small diameter portion 62 have a columnar shape. The outer diameter ODp of the small diameter portion 62 is set slightly smaller than the inner diameter IDp of the small diameter section 57. The outer diameter ODd of the large diameter portion 61 is slightly smaller than the inner diameter IDd of the large diameter section 56 and larger than the inner diameter IDp of the small diameter section 57. A deviation ΔDp between the inner diameter IDp and the outer diameter ODp is set substantially equal to a deviation ΔDd between the inner diameter IDd and the outer diameter ODd.

On the outer peripheral surface of the plunger 32, the boundary between the small diameter portion 62 and the large diameter portion 61 is a step portion 63 which is annular and is perpendicular to the centerline L. The step portion 63 is positioned so as to satisfy the following conditions (i) and (ii).

Condition (i): when the plunger 32 is at the top dead center (as shown in FIG. 7), the step portion 63 is in the drive cam 22 side of the step portion 58 of the slide hole 31.

Condition (ii): when the plunger 32 is at the bottom dead center (as shown in FIG. 3), the step portion 63 is in the pressurizing chamber 35 side of the open end 48 of the slide hole 31.

With regard to the plunger 32 having the aforementioned construction, most part of the small diameter portion 62 is inserted into the small diameter section 57, and a part of the large diameter portion 61 is inserted into the large diameter section 56. An annular space 64 is formed between the small diameter portion 62 and the small diameter section 57. An annular space 65 is formed between the large diameter portion 61 and the large diameter section 56. Further, the fluid reservoir 55 is the annular space that is surrounded by the walls of the step portions 58, 63, the large diameter section 56, and small diameter portion 62.

The fluid reservoir 55 is located close, in the pressuring chamber 35 side, to the drive cam side end portion Ed of the slide hole 31 (i.e. large diameter section 56) at which the plunger 32 contacts the wall 46 of the slide hole 31 at the highest surface pressure (as shown in FIG. 6). Note that the pressure of the fuel 10 supplied to the drive cam side end portion Ed is higher than that supplied to other portions.

As shown in FIG. 8, during an intake stroke where the plunger 32 moves toward the drive cam 22, the plunger 32 inclines in the opposite direction to that it does during a pressurizing stroke. At this time, however, the reaction force Fr is small, and the side force Fs is accordingly small. Therefore, problems such as heat generation and seizure due to the sliding motion of the plunger 32 during a pressurizing stroke hardly occur.

In the high-pressure fuel pump 17 having the aforementioned construction, the plunger 32 is driven by the rotating drive cam 22 to reciprocate in the slide hole 31. More in detail, during this time, most part of the small diameter portion 62 of the plunger 32 reciprocates in the small diameter section 57 of the slide hole 31, and part of the large diameter portion 61 reciprocates in the large diameter section 56.

As shown in FIG. 8, during an intake stroke where the plunger 32 moves toward the drive cam 22, the capacity of the pressurizing chamber 35 increases, and the fuel 10 is sucked into the enlarged pressurizing chamber 35. As the plunger 32 thus moves, the step portion 63 of the plunger 32 moves away from the step portion 58 of the slide hole 31, and the capacity of the fluid reservoir 55 provided in the flow passage 47 increases, whereby the fuel 10 is sucked into the enlarged fluid reservoir 55.

As shown in FIG. 6, during a pressurizing stroke where the plunger 32 moves toward the pressurizing chamber 35, the capacity of the pressurizing chamber 35 decreases, pressurizing the fuel 10 therein. As the plunger 32 thus moves, the step portion 63 of the plunger 32 approaches the step portion 58 of the slide hole 31, and the capacity of the fluid reservoir 55 decreases, pressurizing the fuel 10 in the fuel reservoir 55 and thereby promoting the flow of the fuel 10 to the open end 48. More specifically, provided that the fuel reservoir 55 is filled with the fuel 10 when the capacity of the fluid reservoir 55 is maximum, the amount of fuel 10 that is equivalent to the amount by which the capacity of the fluid reservoir 55 changes (decreases) as the plunger 32 moves toward the pressurizing chamber 35 is discharged from the fuel reservoir 55.

In the embodiment, each of the step portion 63 of the plunger 32 and the step portion 58 of the slide hole 31 extends along a plane perpendicular to the centerline L of the slide hole 31. Therefore, the change in the capacity of the fuel reservoir 55 can be determined as the product of the area of the step portion 58 (or the step portion 63) and the distance that the plunger 32 moves. The change in the capacity, that is, the amount of fuel 10 discharged from the fuel reservoir 55, is larger than when the fuel reservoir is not provided.

Accordingly, even when, during a pressurizing stroke, the plunger 32 inclines and slides in the slide hole 31 while being pressed against the drive cam side end portion Ed of the wall 46 of the slide hole 31, the drive cam side end portion Ed can be sufficiently lubricated and cooled by the large amount of fuel 10 sent from the fluid reservoir 55 in the aforementioned manner.

According to the first embodiment as described above, the following effects can be obtained.

(1) The fluid reservoir 55 is provided in the flow passage 47 of the fuel 10 between the plunger 32 and the wall 46 of the slide hole 31, and the capacity of the fluid reservoir 55 increases as the plunger 32 moves toward the drive cam 22, and decreases as the plunger 32 moves toward the pressurizing chamber 35. Thus, the fluid reservoir 55 enables a large amount of fuel 10 to be supplied to the portion of the flow passage 47 in the drive cam 22 side of the fluid reservoir 55. Therefore, even when the plunger 32 inclines in the slide hole 31 and the plunger 32 slides in the slide hole 31 while being pressed against the drive cam side end portion Ed of the wall 46 of the slide hole 31, the large amount of fuel 10 supplied from the fluid reservoir 55 sufficiently lubricates and cools the drive cam side end portion Ed as described above. As a result, overheating due to the sliding motion of the plunger 32 can be suppressed.

(2) The slide hole 31 includes the large diameter section 56 in the drive cam 22 side and the small diameter section 57 in the pressurizing chamber 35 side, and the plunger 32 includes the large diameter portion 61 in the drive cam 22 side and the small diameter portion 62 in the pressurizing chamber 35 side, and most part of the small diameter portion 62 is inserted into the small diameter section 57, and a part of the large diameter portion 61 is inserted into the large diameter section 56. The fluid reservoir 55 is formed by the annular space created between the annular step portion 58, which is provided between the large diameter section 57 and the small diameter portion 61, and the annular step portion 63, which is provided between the large diameter portion 61 and the small diameter portion 62. In this construction, the capacity of the fluid reservoir 55 increases and decreases as the plunger 32 reciprocates, whereby the fuel 10 is sucked into the fluid reservoir 55 and pressurized therein. Accordingly, the advantage described in (1) can be reliably achieved.

(3) Each of the step portion 58 of the slide hole 31 and the step portion 63 of the plunger 32 extends along a plane perpendicular to the centerline L of the slide hole 31. The amount of fuel 10 that is equivalent to the amount by which the capacity of the fuel reservoir 55 changes (decreases) as the plunger 32 moves toward the pressurizing chamber 35 is discharged from the fluid reservoir 55. The area of each of the step portions 58, 63 and the distance that the plunger 32 moves are the elements that determine the amount of fuel 10 to be discharged from the fluid reservoir 55. Therefore, by adjusting these elements in various manners, the amount of fuel 10 to be discharged from the fluid reservoir 55 can be easily set to the amount necessary for reducing heat due to the sliding motion of the plunger 32.

(4) The fluid reservoir 55 is provided close, in the pressurizing chamber 3 side, to the portion where the plunger 32 contacts the wall 46 of the slide hole at the highest surface pressure (the drive cam side end portion Ed). Providing the fluid reservoir 55 at such a position enables the sucking-in and pressurizing of the fuel 10 to be performed near where the plunger 32 slides on the wall 46 of the slide hole 31 at the high surface pressure. Therefore, a large amount of fuel 10 can be supplied at a high pressure to the portion that is subjected to a high surface pressure and a large amount of heat and therefore particularly needs to be cooled and lubricated.

Figure 9:
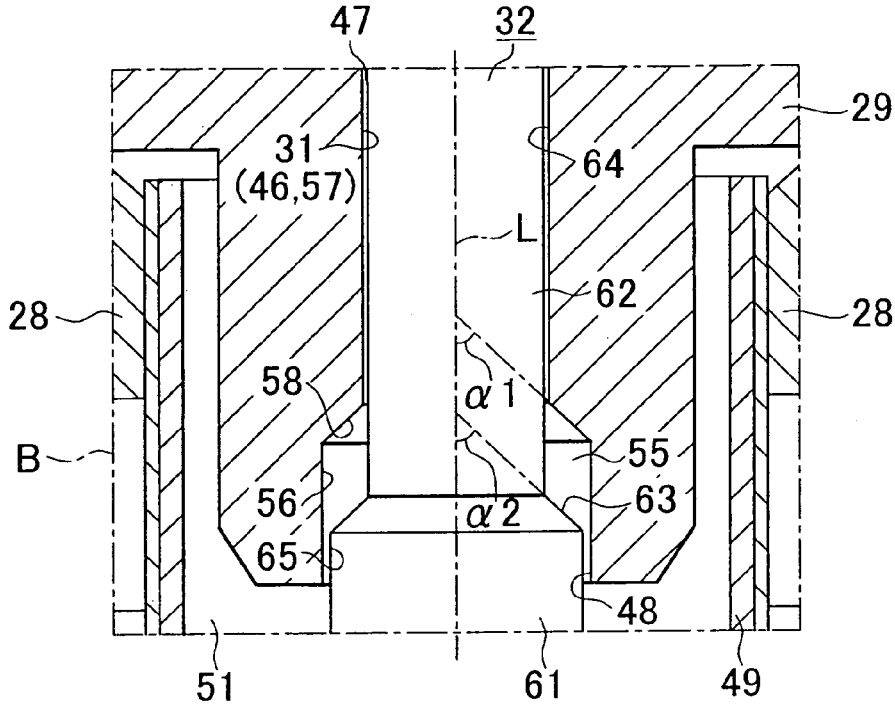
FIG. 9 is an enlarged cross-sectional view showing the fluid reservoir and its surrounding area of the second embodiment of the invention which corresponds to the B portion in FIG. 4.

Next, a second embodiment of the invention will be described with reference to FIG. 9. In the second embodiment, the step portion 58 of the slide hole 31 and the step portion 63 of the plunger 32, which together define the fluid reservoir 55, are differently shaped from those in the first embodiment. More specifically, the step portion 58 of the slide hole 31 is tapered such that the diameter of the step portion 58 gradually increases toward the drive cam 22 (downside in FIG. 9). Similarly, the step portion 63 of the plunger 32 is tapered such that the diameter of the step portion 63 gradually increases toward the drive cam 22. The degrees of tapering of the step portions 58, 63 are represented by angles $\alpha 1$, $\alpha 2$, respectively, with respect to the centerline L of the slide hole 31. The angles $\alpha 1$, $\alpha 2$ are set substantially equal to each other.

The step portion 63 of the plunger 32 is positioned so as to satisfy the conditions (iii), (iv) described below.

Condition (iii): when the plunger 32 is at the top dead center, the upper end portion of the step portion 63 (the portion closest to the small diameter portion 62) is closer to the drive cam 22 than the upper end portion of the step portion 58 (the portion closest to the small diameter portion 57) is.

Condition (iv): when the plunger 32 is at the bottom dead center, the lower end portion of the step portion 63 (the portion closest to the large diameter portion 61) is closer to the pressurizing chamber 35 than the open end 48 of the slide hole 31 is.

The structures other than described above are the same as those in the first embodiment. Therefore, the same components and portions as the first embodiment are denoted by the same reference numerals, and descriptions thereof are omitted.

In the high-pressure fuel pump 17 of the second embodiment having the aforementioned construction, the step portion 58 of the slide hole 31 is tapered such that the inner diameter of the step portion 58 increases toward the drive cam 22, and therefore the clearance between the step portion 58 and the small diameter portion 62 of the plunger 32 increases toward the drive cam 22. As such, the resistance against the fuel 10 that is discharged from the pressurizing chamber 35 to the fluid reservoir 55 during an intake stroke in which the plunger 32 moves toward the drive cam 22 is smaller than when the step portion 58 is made perpendicular to the centerline L of the slide hole 31.

The step portion 63 of the plunger 32 is tapered such that the outer diameter of the step portion 63 increases toward the drive cam 22, and therefore the clearance between the step portion 63 and the large diameter section 56 of the slide hole 31 decreases toward the drive cam 22. Therefore, the resistance against the fuel 10 discharged from the fluid reservoir 55 during a pressurizing stroke in which the plunger 32 moves toward the pressurizing chamber 35 is smaller than when the step portion 63 is made perpendicular to the centerline L of the slide hole 31.

As a result, according to the second embodiment, the following advantages can be obtained in addition to the advantages (1), (2), (4) described above.

(5) The step portion 58 of the slide hole 31 is tapered such that the diameter of the step portion 58 gradually increases toward the drive cam 22. Therefore, the resistance against the fuel 10 flowing into the fluid reservoir 55 during an intake stroke decreases. As a result, the fuel 10 can be efficiently sucked into the fuel reservoir 55.

(6) The step portion 63 of the plunger 32 is tapered such that the diameter of the step portion 63 gradually increases toward the drive cam 22. Therefore, the resistance against the fuel 10 discharged from the fluid reservoir 55 during a pressurizing stroke decreases, which improves the flowability of fuel 10 and thus the lubrication and cooling performances.

Figure 10:
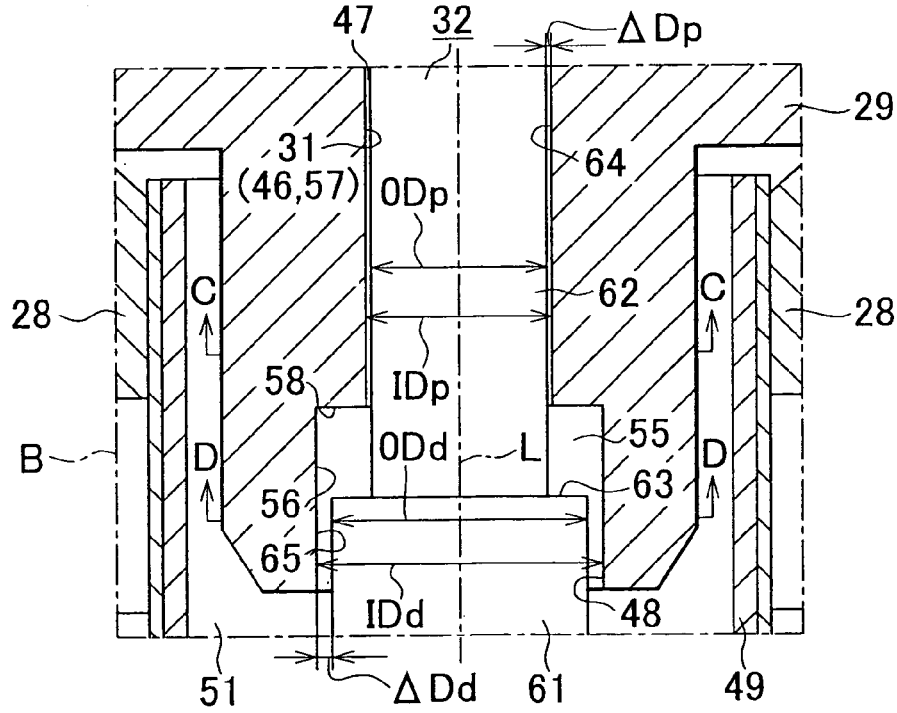
FIG. 10 is an enlarged cross-sectional view showing the fluid reservoir and its surrounding area of the third embodiment of the invention which corresponds to the portion B in FIG. 4.
Figure 11A:
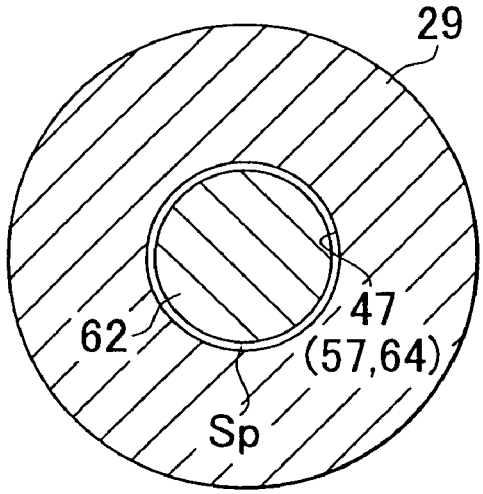
FIG. 11A is a cross-sectional view taken along the line C-C in FIG. 10.
Figure 11B:
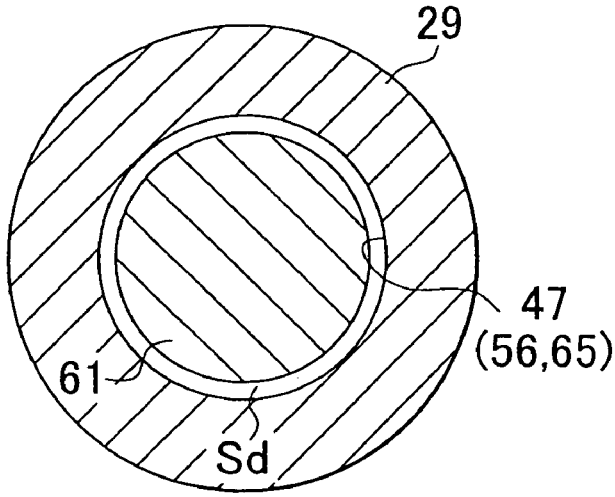
FIG. 11B is a cross-sectional view taken along the line D-D in FIG. 10.

A third embodiment according to the invention will be described with reference to FIGS. 10 and 11. In the third embodiment, the area of the flow passage 47 between the wall 46 of the slide hole 31 and the plunger 32, which is measured along a plane perpendicular to the centerline L of the slide hole 31, (hereinafter, "cross-sectional area of the flow passage 47"), is different between the space 65 in the drive cam 22 side of the fluid reservoir 55 and the space 64 in the pressurizing chamber 35 side of the fluid reservoir 55. If the former cross-sectional area is denoted Sd and the latter is denoted Sp, the relationship of Sd>Sp is established.

In order to establish the above relationship, the outer diameter ODd of the large diameter portion 61 of the plunger 32 is smaller than that in the first embodiment. Thus, the deviation $\Delta$Dd between the inner diameter IDd of the large diameter section 56 and the outer diameter ODd of the large diameter portion 61 is larger than that in the first embodiment. However, the deviation $\Delta$Dp between the inner diameter IDp of the small diameter section 57 and the outer diameter ODp of the small diameter portion 62 is the same as that in the first embodiment. That is, the deviation $\Delta$Dd is larger than the deviation $\Delta$Dp, and the cross-sectional area Sd of the space 65 in the flow passage 47 is larger than the cross-sectional area Sp of the space 64 in the same passage 47. The structures other than described above are the same as those in the first embodiment. Therefore, the same components and portions as in the first embodiment are denoted by the same reference numerals, and descriptions thereof are omitted.

In the high-pressure fuel pump 17 of the third embodiment having the aforementioned construction, as the plunger 32 moves toward the pressurizing chamber 35 and the capacity of the fluid reservoir 55 decreases, the fuel 10 in the fluid reservoir 55 is discharged from the fuel reservoir 55 to either or both of the space 65 in the drive cam 22 side and the space 64 in the pressurizing chamber 35 side. At this time, a larger amount of fuel 10 is discharged from the fluid reservoir 55 to where the flow resistance is smaller, that is, to the space having one of the cross-sectional areas Sd and Sp which is larger than the other. Thus, in the embodiment constructed as above, a larger amount of fuel 10 flows to the space 65 having the cross-sectional area Sd.

The space 65 includes a portion where, during a pressurizing stroke, the plunger slides on the wall 46 of the slide hole 31 at a high surface pressure and much heat is therefore generated (i.e., a portion around the drive cam side end portion Ed). Therefore, a large amount of fuel 10 is supplied to the drive cam side end portion Ed.

As a result, according to the third embodiment, the following advantage can be obtained in addition to the advantages (1) to (4) described above.

(7) In the flow passage 47, the cross-sectional area Sd of the space 65 is larger than the cross-sectional area Sp of the space 64. Therefore, a larger amount of fuel 10 is supplied to the space 65 from the fluid reservoir 55 so as to effectively lubricate and cool the drive cam side end portion Ed.

Figure 12:
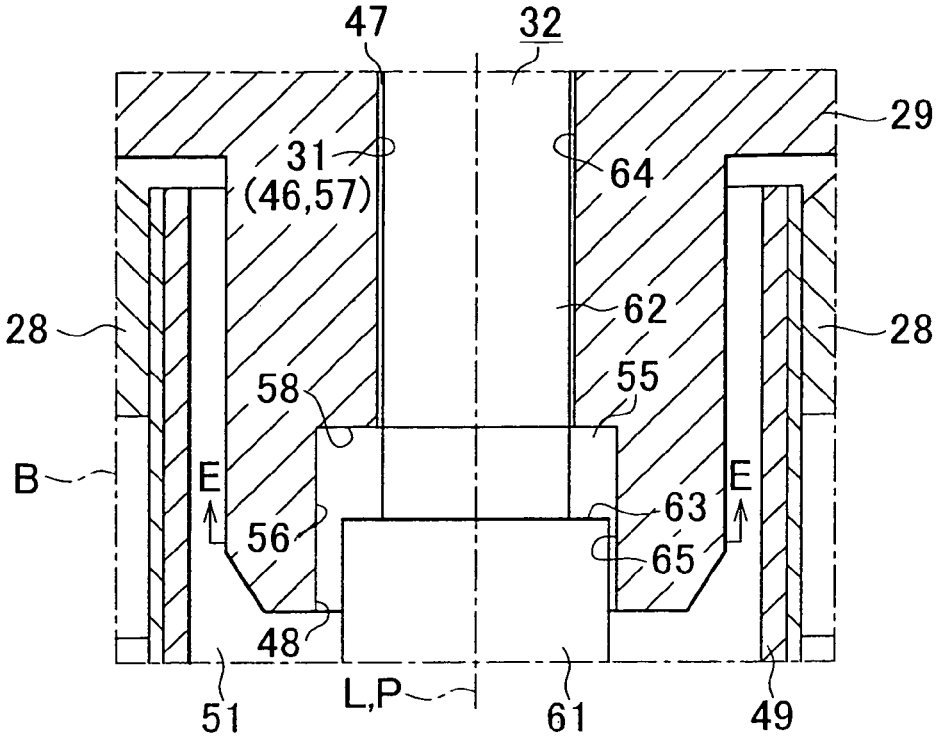
FIG. 12 is an enlarged cross-sectional view showing the fluid reservoir and its surrounding area of the fourth embodiment of the invention which corresponds to the portion B in FIG. 4.
Figure 13:
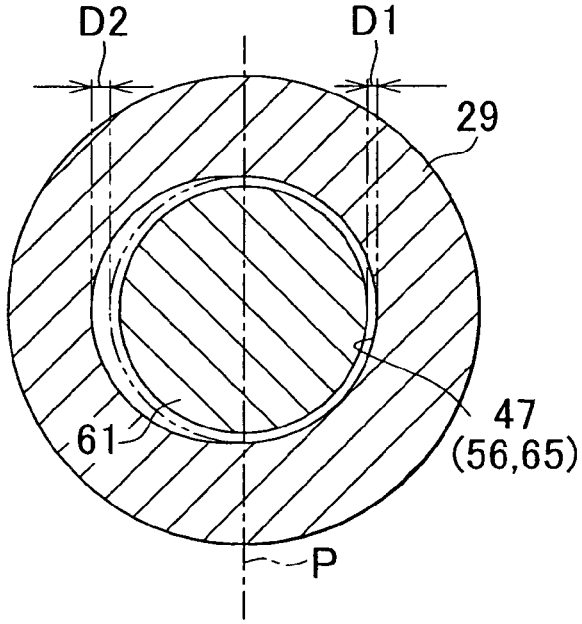
FIG. 13 is a cross-sectional view taken along the line E-E in FIG. 12.

A fourth embodiment according to the invention will be described with reference to FIGS. 12 and 13.

In the fourth embodiment, the space 65 of the fuel passage 47 in the drive cam 22 side of the fluid reservoir 55 is differently formed from the third embodiment. In the following description, it is assumed that the space 65 is divided into "contact side" and "non-contact side" with respect to a plane P extending through the rotation center R of the camshaft 21 and the centerline L of the slide hole 31. Specifically, the contact side is one side of the space 65 where the drive cam 22 contacts the lifter 38 during a pressurizing stroke (i.e., the left side in FIGS. 12 and 13), while the non-contact side is the other side of the space 65 where the drive cam 22 does not contact the lifter 38 (i.e., the right side in FIGS. 12 and 13). In the embodiment, a clearance D2 in the contact side is set larger than a clearance D1 in the non-contact side.

With the clearances D1, D2 thus set, in the fourth embodiment, the cross-sectional shape of the large diameter section 56 is non-circular. More specifically, the cross-sectional shape of the large diameter section 56 is semicircular in the non-contact side with respect to the plane P while, in the non-contact side, it is substantially semi-elliptic, so that the cross sectional area of the large diameter portion is larger in the contact side than in the non-contact side. Note that the large diameter portion 61 is columnar-shaped as in the third embodiment. The two dotted line in FIG. 13 indicates, for comparison, the cross-sectional shape of the large diameter section 56 when it is semicircular also in the contact side. In FIG. 14, the area outside the two-dotted line represents the area where the clearance D2 is extended.

Since the shape of the large diameter section 56 is thus different between the two sides, the clearance D1 is constant at any point in the space 65 along its circumferential direction while the clearance D2 changes such that it is smallest (substantially equal to the clearance D1) in the proximity of the plane P and increases toward the side opposite to the plane P and becomes largest at the point distal from the plane P.

The structures other than described above are the same as those in the third embodiment. Therefore, the same components and portions as the third embodiment are denoted by the same reference numerals, and descriptions thereof are omitted.

In the high-pressure fuel pump 17 according to the fourth embodiment having the aforementioned construction, when the fuel 10 is discharged from the fluid reservoir 55 into the space 65 of the flow passage 47, majority of it is discharged to a portion with a larger clearance between the plunger 32 and the wall 46 of the large diameter section 56 and thus with a smaller flow resistance. In the fourth embodiment, this larger clearance between the plunger 32 and the wall 46 of the large diameter section 56 is made in the side where the plunger 32 contacts the drive cam side end portion Ed of the wall 46 of the large diameter section 56 when the plunger 32 moves toward the pressurizing chamber 35. Therefore, majority of fuel 10 discharged from the fluid reservoir 55 to the space 65 can be supplied to where lubrication and cooling by the fuel 10 is particularly needed.

As a result, according to the fourth embodiment, the following advantage can be obtained in addition to the advantages (1) to (4) and (7) described above.

(8) With respect to the clearances D1, D2 between the large diameter portion 61 and the wall 46 of the large diameter section 56 in the space 65, the clearance D2 in the side where the plunger 32 contacts the drive cam side end portion Ed of the wall 46 of the slide hole 31 when the plunger 32 moves toward the pressurizing chamber 35 is larger than the clearance D1 in the side where the plunger 32 does not contact the drive cam side end portion Ed. Therefore, the flow of fuel 10 from the fluid reservoir 55 can be concentrated to the portion of the space 65 which particularly needs to be lubricated and cooled, and as a result, the efficiency of lubrication and cooling improves.

It should be noted that the invention may be embodied in various other manners and forms as described below.

Either one of the step portion 58 of the slide hole 31 and the step portion 63 of the plunger 32 in the second embodiment may be formed so as to extend along a plane perpendicular to the centerline L of the slide hole 31.

In the second embodiment, the angle $\alpha 1$ between the step portion 58 and the centerline L and the angle $\alpha 2$ between the step portion 63 the centerline L may be different from each other.

In the third and forth embodiments, the step portion 58 of the slide hole 31 and the step portion 63 of the plunger 32 may tapered such that their diameters gradually increase toward the drive cam 22, as in the second embodiment.

Figure 14A:
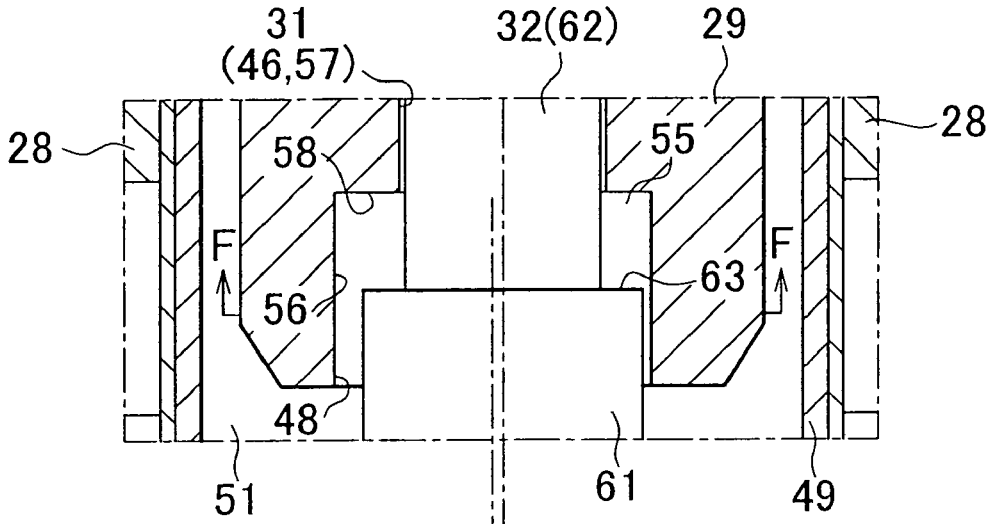
FIG. 14A is a partially enlarged cross-sectional view showing other embodiment of the fluid reservoir.
Figure 14B:
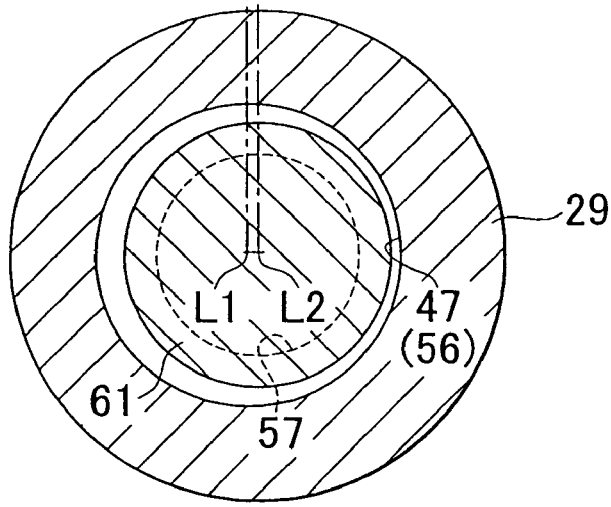
FIG. 14B is a cross-sectional view taken along the line F-F in FIG. 14A.
Figure 15:
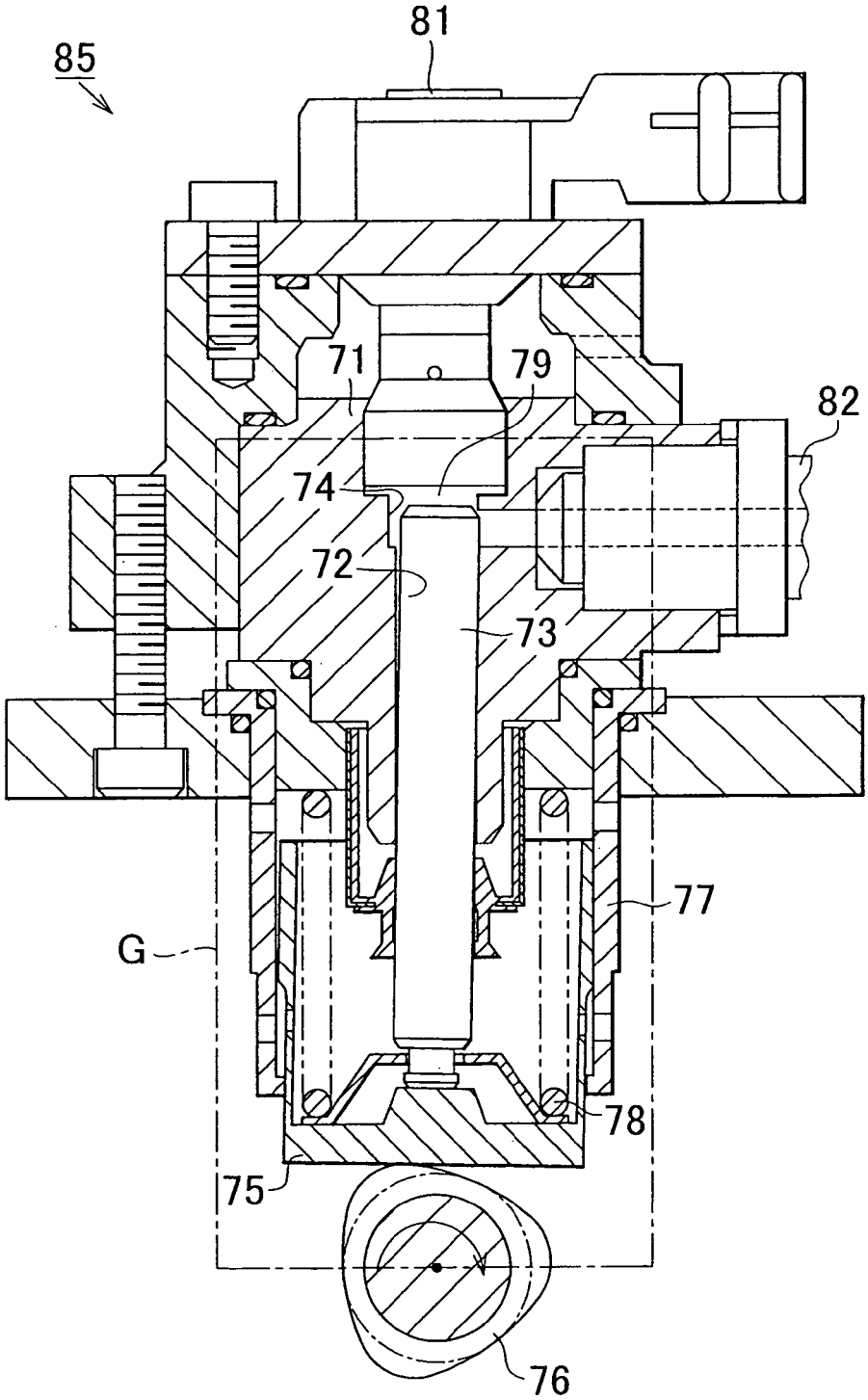
FIG. 15 Related Art
FIG. 15 is a cross-sectional view of the high-pressure fuel pump of a related art.
Figure 16:
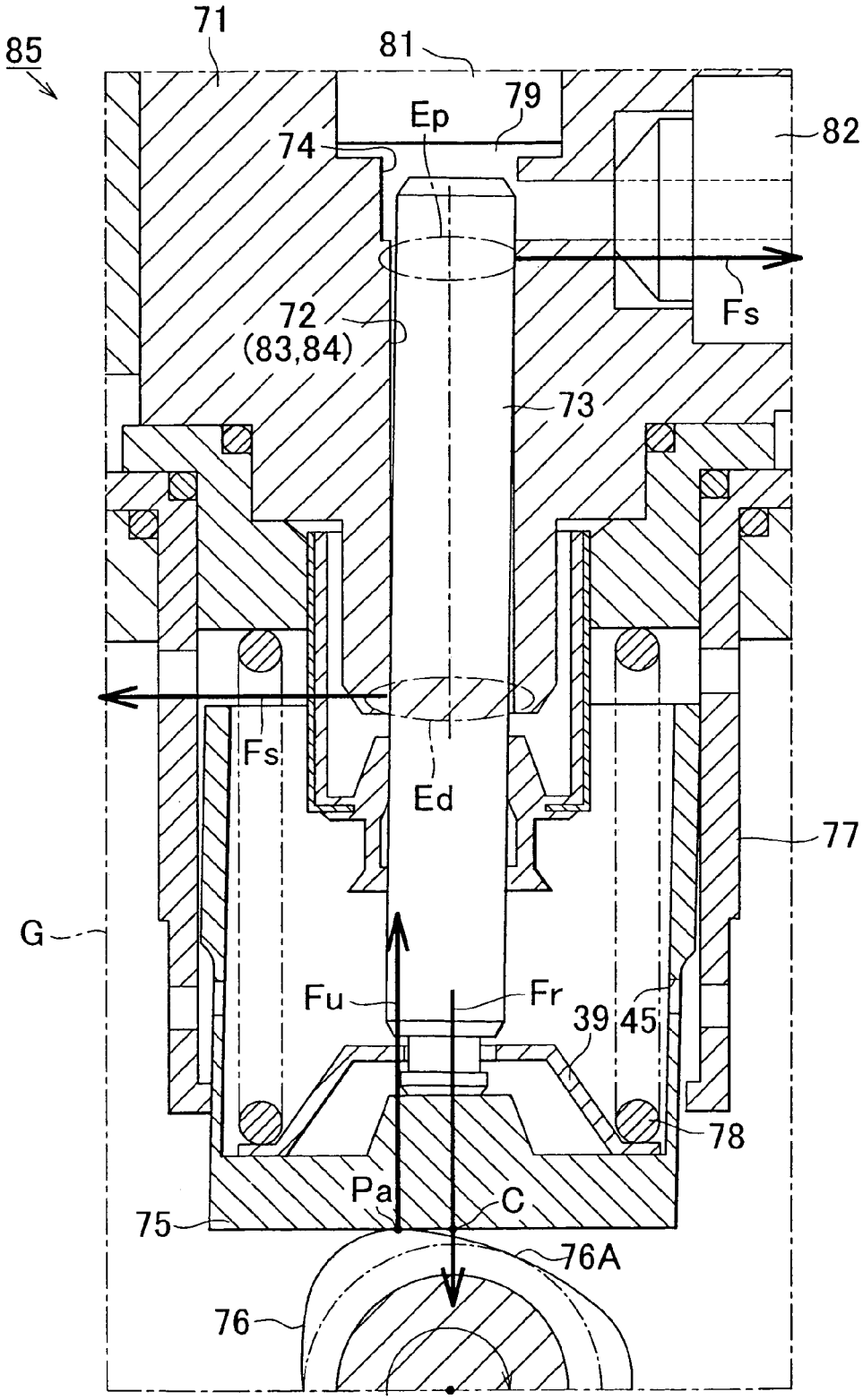
FIG. 16 Related Art
FIG. 16 is an enlarged cross-sectional view of the portion G shown in FIG. 15.

Also, the fourth embodiment may be modified as follows. The cross-sectional shape of the large diameter section 56 is circular as shown in FIGS. 14(A) and 14(B). The centerline of the large diameter section 56 is denoted L1, and the centerline of the small diameter section 57 is denoted L2. When manufacturing the cylinder body 29, the large diameter section 56 and the small diameter section 57 are formed such that the centerline L1 of the large diameter section 56 is offset from the centerline L2 of the small diameter section 57. More specifically, the centerline L1 is offset from the centerline L2 to the side of the aforementioned plane 9 in which the drive cam 22 contacts the lifter 38 during a pressurizing stroke of the plunger 32 (i.e., the left side in FIGS. 14(A), 14(B)). In this case, the relationship D2>D1 is established between the clearances D1, D2. As a result, the same advantages as in the fourth embodiment can be achieved.

The invention may be applied to a high-pressure fuel pump in which the electromagnetic spill valve 42 closes a little after the bottom dead center.

The invention may be applied to a high-pressure pump other than a high-pressure fuel pump of an engine.

The drive cam 22 may be a drive cam that is provided independent from the camshaft 21 so as to drive the plunger 32 to reciprocate.

While the invention has been described with reference to embodiments thereof, it is to be understood that the invention is not limited to the embodiments or constructions. To the contrary, the invention is intended to cover various modifications and equivalent arrangements. In addition, while the various elements of the embodiments are shown in various combinations and configurations, which are exemplary, other combinations and configurations, including more, less or only a single element, are also within the spirit and scope of the invention.

What is claimed is:

1. A high-pressure pump comprising:

a plunger, and a cylinder body in which a pressurizing chamber is provided, wherein the plunger is inserted into a slide hole of the cylinder body provided between the pressurizing chamber and a drive cam, so as to slide and reciprocate within the slide hole;

a biasing member which biases the plunger towards the drive cam and the drive cam allows movement of the plunger toward the drive cam so as to cause fluid to be sucked into the pressurizing chamber;

a drive cam nose of the drive cam moves the plunger toward the pressurizing chamber so as to cause the fluid to be pressurized in the pressurizing chamber;

a flow passage of the fluid discharged from the pressurizing chamber forms a space between the plunger and a wall of the slide hole;

a fluid reservoir is provided in the flow passage to store the fluid, the fluid reservoir's capacity increases as the plunger moves toward the drive cam and decreases as the plunger moves toward the pressurizing chamber; and a reservoir chamber is fluidly connected to the fluid reservoir for returning the fluid to a fuel tank.

2. The high-pressure pump according to claim 1, wherein the slide hole includes a large diameter section provided in the drive cam side and a small diameter section provided in the pressurizing chamber side; and the plunger includes a large diameter portion provided in the drive cam side and a small diameter portion provided in the pressurizing chamber side;

the large diameter portion is inserted into the large diameter section;

the small diameter portion is inserted into the small diameter section; and the fluid reservoir is a space between a step portion of the slide hole and a step portion of the plunger, the step portion of the slide hole being provided between the large diameter section and the small diameter section, and the step portion of the plunger being provided between the large diameter portion and the small diameter portion.

3. The high-pressure pump according to claim 2, wherein each of the step portion of the slide hole and the step portion of the plunger extends along a plane perpendicular to a centerline of the slide hole.

4. The high-pressure pump according to claim 2, wherein the step portion of the slide hole is tapered such that the diameter of the step portion of the slide hole increases toward the drive cam .

5. The high-pressure pump according to claim 2, wherein the step portion of the plunger is tapered such that the diameter of the step portion of the plunger increases toward the drive cam.

6. The high-pressure pump according to claim 1, wherein a portion of the flow passage in the drive cam side of the fluid reservoir has a larger cross-sectional area than a cross-sectional area of a portion of the flow passage in the pressurizing chamber side of the fluid reservoir.

7. The high-pressure pump according to claim 6, wherein at the portion of the flow passage in the drive cam side of the fluid reservoir, the clearance between the plunger and the wall of the slide hole is larger in a side where the plunger contacts a drive cam side end portion of the wall of the slide hole than in a side where the plunger does not contact the drive cam side end portion of the wall of the slide hole.

8. The high-pressure pump according to claim 1, wherein the fluid reservoir is provided close to a first portion where the plunger contacts the wall of the slide hole at a highest surface pressure.

9. The high-pressure pump according to claim 8, wherein a pressure of the fluid supplied to a proximity of the first portion is larger than a pressure of the fluid supplied to a portion other than the first portion.

* * * * *